US005577161A

United States Patent [19]

Pelaez Ferrigno

[11] Patent Number: 5,577,161

[45] Date of Patent: Nov. 19, 1996

[54] NOISE REDUCTION METHOD AND FILTER FOR IMPLEMENTING THE METHOD PARTICULARLY USEFUL IN TELEPHONE COMMUNICATIONS SYSTEMS

[75] Inventor: Clara S. Pelaez Ferrigno, Cava Del Tirreni, Italy

[73] Assignee: Alcatel N.V., Rijswijk, Netherlands

[21] Appl. No.: 309,015

[22] Filed: Sep. 20, 1994

[30] Foreign Application Priority Data

Sep. 20, 1993 [IT] Italy ..... MI93A2018

[51] Int. Cl.[6] ..... G10L 3/02

[52] U.S. Cl. ..... 395/2.35; 395/2.42; 395/2.2

[58] Field of Search ..... 395/2.12, 2.2, 395/2.23, 2.28, 2.33–2.37, 2.42; 381/46, 47

[56] References Cited

U.S. PATENT DOCUMENTS

| | | | |
|---|---|---|---|
| 5,012,519 | 4/1991 | Adlersberg et al. | 395/2.35 |
| 5,097,510 | 3/1992 | Graupe | 381/47 |
| 5,355,431 | 10/1994 | Kane et al. | 395/2.35 |
| 5,432,859 | 7/1995 | Yang et al. | 395/2.35 |

FOREIGN PATENT DOCUMENTS 01411360 2/1991 European Pat. Off. .

OTHER PUBLICATIONS

"Frequency Domain Noise Suppression Approaches In Mobile Telephone Systems", Jin Yang, published in Proc. ICASSP, vol. 2, pp. 363–366, Apr. 1993.

"Speech Enhancement Using A Soft–Decision Noise Suppression Filter", Robert J. McAulay et al., IEEE Transactions on ASSP, vol. 28, No. 2, pp. 137–145, Apr. 1980.

*Primary Examiner*—Kee M. Tung

*Attorney, Agent, or Firm*—Spencer & Frank

[57] ABSTRACT

Noise reduction using a digital signal processor includes receiving an input signal which may include a noise-corrupted information signal and/or a noise signal, filtering the noise-corrupted information signal to reduce noise content, and outputting a filtered information signal having the noise content reduced. The filtering includes estimating the spectral envelope of the noise-corrupted information signal amplitude using the formula:

$$E(A|X,O;H1)*p(H1|X,O)+E(A|X,O;H0)*p(H0|H,O),$$

where X is the spectral envelope of the amplitude of the noise-corrupted information signal, O is the spectral envelope of the noise signal power, H0 denotes the statistical event corresponding to a non-information interval, and H1 denotes the statistical event corresponding to an information interval.

17 Claims, 1 Drawing Sheet

NOISE REDUCTION METHOD AND FILTER FOR IMPLEMENTING THE METHOD PARTICULARLY USEFUL IN TELEPHONE COMMUNICATIONS SYSTEMS

CROSS REFERENCE TO RELATED APPLICATION

This application claims the priority of Italian Application No. P MI93A002018 filed Sep. 20, 1993, which is incorporated herein by reference.

BACKGROUND OF THE INVENTION

1. Field of The Invention

The invention relates to the field of noise reduction, and in particular to a noise reduction method and filter for implementing the method having particular usefulness in telephone communications systems.

2. Background Information

In telephone communications systems, noise can originate with various sources. Background acoustical noise represents one of the major impairments in telephone voice communications, especially in hands-free mobile telephone systems.

Over the years, many contributions to a solution for the problem of noise reduction for noise-corrupted voice signals in telephone communications have been made. One of the possible approaches is so-called "noise suppression," wherein the noise spectrum is estimated during pauses in the voice signal, and such estimates are used during voice containing periods following the pauses to reduce the noise content of the noise-corrupted information signal.

Such problems become more serious in high-noise environments, e.g., the inside of a car. A recent proposal on this matter is contained in an article by J. Yang, titled "Frequency Domain Noise Suppression Approaches in Mobile Telephone Systems", published in Proc. ICASSP, vol. 2, pp. 363–366, April 1993, hereby incorporated by reference. This article describes a further processing of the technique proposed by R. J. McAulay, M. L. Malpass in "Speech Enhancement Using a Soft-Decision Noise Suppression Filter", IEEE Transactions on ASSP, vol. 28, No. 2, pp 137–145, April 1980, hereby incorporated by reference.

In the previous articles a noise suppression method based on a modified maximum likelihood estimate is developed. Noise suppression is carried out by first decomposing the corrupted speech signal into different frequency subbands. The noise power of each subband is the estimated during non-voice periods. Noise suppression is achieved through the use of suppression factor corresponding to the temporal signal power over estimated noise power ratio of each subband.

SUMMARY OF THE INVENTION

In order to solve the above-mentioned problems the present invention provides the following novel features and advantages.

The main task of the present invention is to make a further contribution for the solution to the problem of noise reduction in voice systems, such as in mobile telephone communications and automatic speech recognition applications.

In view of this task, an object of the present invention is to improve the above mentioned method adapting it to meet automatic speech recognition requirements.

Another object of the present invention is to take the memory effect into account, which is linked to the suppression technique itself. That is, to reduce the memory requirements for the noise reduction.

A further object of the present invention is to limit the computational complexity required to implement noise reduction.

The above tasks, as well as the aforesaid and other objects, will be achieved through the noise reduction method, and filter implementing the method, as disclosed and described herein.

The noise reduction method using a digital signal processor includes receiving an input signal which may include a noise-corrupted information signal and/or a noise signal, filtering the noise-corrupted information signal to reduce noise content, and outputting a filtered information signal having the noise content reduced. The filtering includes estimating the spectral envelope of the noise-corrupted information signal amplitude using the formula:

$$E(A|X,O;H1)*p(H1|X,O)+E(A|X,O;H0)*p(H0|H,O),$$

where X is the spectral envelope of the amplitude of the noise-corrupted information signal, O is the spectral envelope of the noise signal power, H0 denotes the statistical event corresponding to a non-information interval, and H1 denotes the statistical event corresponding to an information interval.

In a further embodiment, the spectral envelope X in an interval i is corrected according to the formula:

$$\overline{X_i(\omega)}=k_x\overline{X_{i-1}(\omega)}+(1-k_x)X_i(\omega)$$

in that the spectral envelope O in the interval i is corrected according to the formula:

$$\overline{O_i(\omega)}=k_o\overline{O_{i-1}(\omega)}+(1-k_o)O_i(\omega)$$

and in that E(A|X,O; H0) is calculated according to the formula Rmax*X, where Rmax is given by $$KK*\frac{1}{2}\left\{1-erf\left(\sqrt{1n\frac{1}{p_{fa}}}-\sqrt{\frac{S}{N}}\right)\right\}$$

where $p_{fa}$ is the probability of false alarm in time interval i and S/N is the signal-to-noise power ration in time interval i.

According to a further embodiment, the probability of a false alarm in a period of time is calculated using the ratio of the length of time during which the envelope of the noise signal amplitude keeps above a predetermined threshold, to the length of said period of time.

In a further embodiment, the filtering includes making an information/non-information decision using the predetermined threshold.

In another embodiment, the value of $K_x$ is chosen in the interval (0.1, 0.5) and the value of $K_0$ in the interval (0.5, 0.9).

In another embodiment, the receiving includes (a) subdividing the input signal samples into subsequences having the same length corresponding to the length of said time interval, so that adjacent subsequences have a predetermined number of samples shared; (b) applying a window function to said subsequences thus obtaining windowed subsequences; and (c) applying the Fourier transform to said windowed subsequences thus obtaining transformed subsequences. The filtering step may include making an information/non-information decision, applying the information/non-information decision to said subsequences, and in the case of non-information, calculating the spectral envelope O of the noise signal power for calculating a suppression function F(w).

In a further embodiment of the method, the filtering step further includes applying a suppression function F(w) to the transformed subsequences thus obtaining filtered subsequences, the function being calculated for each subsequence on the basis of the spectral envelopes X and O in the corresponding subsequences, according to the formula:

$$1/X*\{E(A|X,O;H1\}*p(H1|X,O)+E(A|X,O;H0)*p(H0|H,O)\}.$$

In another embodiment, the outputting step includes (a) applying an inverse Fourier transform to said filtered subsequences; and (b) constructing an output sequence so that adjacent filtered subsequence are summed at ends in said predetermined number of samples.

In any of the above embodiments, the information signal may be a speech signal, and the decision is a speech/non-speech decision. The digital signal processor may be a special purpose digital signal processor and/or a pre-programmed data processor.

A digital signal processor implemented noise reduction filter according to the invention includes (a) means for subdividing input signal samples of an input signal which may include a noise-corrupted information signal and/or a noise signal, into subsequences having the same length corresponding to the length of a time interval, so that adjacent subsequences have a predetermined number of samples shared; (b) means for applying a window function to said subsequences thus obtaining windowed subsequences; (c) means for applying a Fourier transform to said windowed subsequences thus obtaining transformed subsequences; (d) means for estimating a spectral envelope of the noise-corrupted information signal amplitude using the formula:

$$E(A|X,O;H1)*p(H1|X,O)+E(A|X,O;H0)*p(HO|H,O),$$

(e) means for applying a suppression function F(w) to said transformed subsequences thus obtaining filtered subsequences, said function being calculated for each subsequence on the basis of said spectral envelopes X and O in the corresponding subsequence, according to the formula:

$$1/X*\{E(A|X,O;H1\}*p(H1|X,O)+E(A|X,O;H0)*p(HO|H,O)\}$$

(f) means for applying an inverse Fourier transform to said filtered subsequences; and (g) means for constructing an output sequence so that adjacent filtered subsequence are summed at ends in said predetermined number of samples.

The digital signal processor may be special purpose digital signal processor or a pre-programmed data processor.

BRIEF DESCRIPTION OF THE DRAWINGS

The above and other features of the invention will become apparent from the following detailed description taken with the drawing in which.

DETAILED DESCRIPTION OF THE PREFERRED EMBODIMENT(S)

Figure 1:
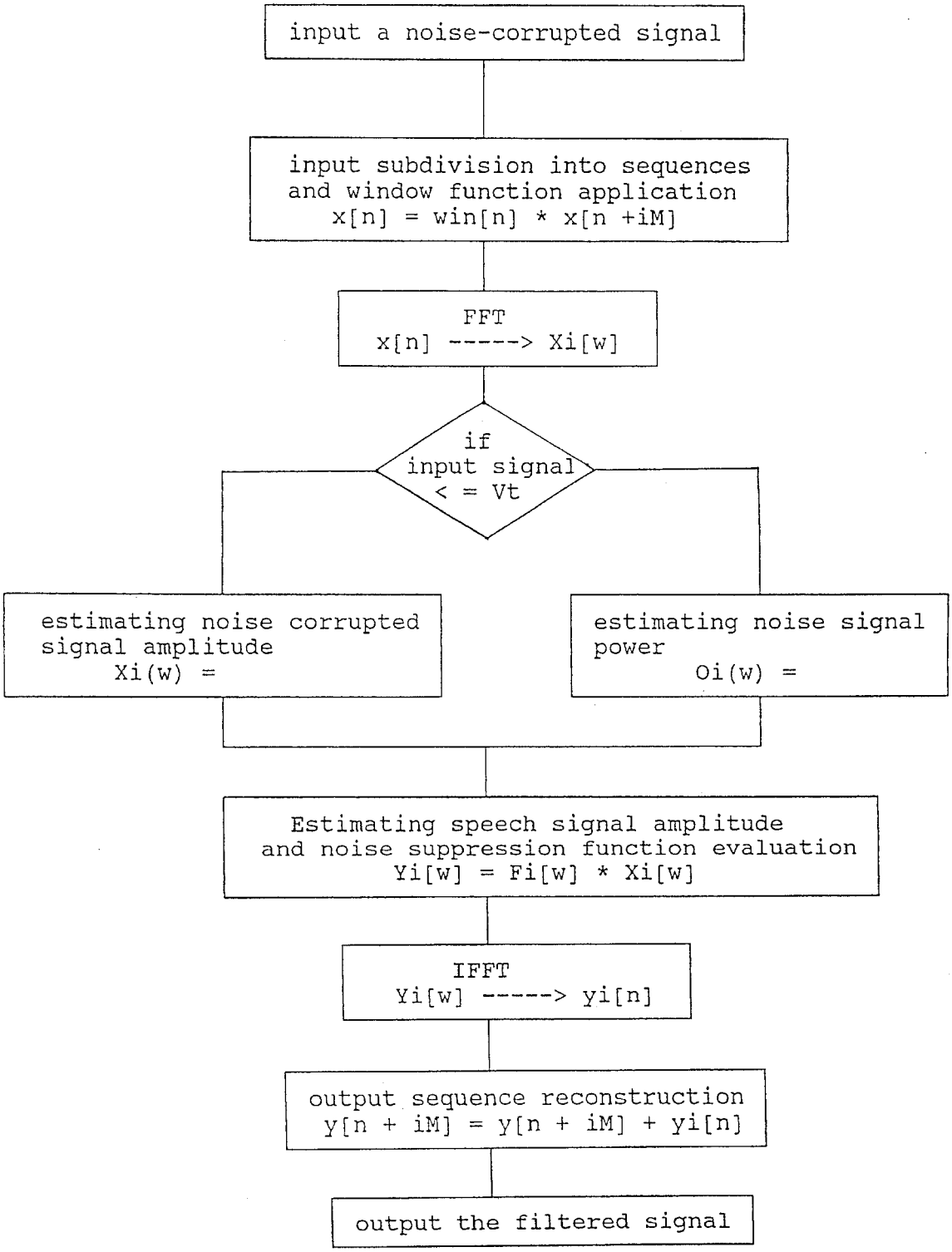
FIG. 1 is a functional block diagram illustrating an embodiment of a noise reduction system according to the present invention.

The invention will now be described in more detail by example with reference to the embodiment shown in the Figure. It should be kept in mind that the following described embodiment is only presented by way of example and should not be construed as limiting the inventive concept to any particular physical configuration.

The invention will be described by considering the case where the information signal corrupted with noise is a speech signal, however, it should be kept in mind that the invention is not limited in application to reducing noise in speech signals.

An assumption is made that the noise is a Gaussian random process and that a speech event is defined by a deterministic signal with unknown phase and amplitude. A received speech signal is composed of the amplitude and phase of the speech, plus noise.

The perception of speech is insensitive to phase, therefore the problem of extricating a speech signal from a corrupted signal can be simplified to estimate the speech amplitude. With the present invention method, the estimate of the spectral envelope of the speech signal amplitude is calculated according to the following formula:

$$E\{A|X,O;H1\}*p(H1|X,O)+E\{A|X,O;H0\}*p(HO|H,O),$$

where:

X is the spectral envelope of the amplitude of the noise-corrupted signal in such time interval.

O is the spectral envelope of the noise power in such interval,

H0 denotes the statistical event corresponding to the fact that such time interval is a non-speech interval, and H1 denotes the statistical event corresponding to the fact that such time interval is a speech interval.

As well known in statistics, E{A|B} indicates the conditional expectation of a statistical variable A subject to statistical variable B, and p(C|D) indicates the conditional probability of event C, subject to the hypothesis that event D has occurred. As a result, term E{A|X,O;H1} reads:

"conditional expectation of the spectral envelope of the speech signal amplitude A in the interval, e.g., "i", subject to the hypothesis that in the interval "i" the spectral envelope of the noise-corrupted signal is X and the spectral envelope of the noise power is 0, in the hypothesis that interval "i" is a speech interval, i.e., it corresponds to speech";

while the term p(H1|X,O) reads:

"conditional probability that event H1 has occurred in interval "i", i.e., that it is of speech type, subject to the hypothesis that in interval "i" the spectral envelope of the noise-corrupted signal is X and the spectral envelope of the noise power is 0"

The spectral envelopes X and O in a generic time interval can be obtained by applying the Fourier transform: in particular, if the time interval is a non-speech (pause in the speech) interval, the Fourier transform of the variation of the speech signal with the time in the interval will provide the spectral envelope O (that, in this circumstance, coincides with the spectral envelope X), i.e., of the noise power, while if the time interval is a speech interval (speech proper), it will provide the spectral envelopes; it is often convenient to use the discrete Fourier transform, in particular when the method is implemented with automatic computation means.

From the above, it is not possible to calculate the spectral envelope O directly in a speech time interval; hence when the aforesaid formula has to be calculated in a speech interval, the spectral envelope O corresponding to the last non-speech interval will be used.

A first improvement of the method can be obtained by using, in calculating the aforesaid formula, a spectral envelope X in the interval "i" corrected in accordance with the formula:

$$\overline{X_i(\omega)}=k_x\overline{X_{i-1}(\omega)}+(1-k_x)X_i(\omega)$$

where $k_x$ is the forgetting factor of the signal and is preferably chosen in the interval (0.1, 0.5).

The envelope X corrected in the interval "i" corresponds to the linear combination of the envelope X calculated in the interval "i" and of the corrected envelope X of the preceding interval.

A second improvement of the method can be obtained by using, in calculating the aforesaid formula, a spectral envelope O is the interval "i" corrected according to the formula:

$$\overline{O_i(\omega)}=k_o\overline{O_{i-1}(\omega)}+(1-k_o)O_i(\omega)$$

where $k_o$ is the noise forgetting factor and it is preferably chosen in the interval (0.5, 0.9).

The envelope corrected in the interval "i" corresponds to the linear combination of the envelope O calculated in the interval "i" and of the corrected envelope O of the preceding interval. The term E(A|X,O; H0), mean value of the speech in a non-speech interval, should theoretically be null.

Indeed, a speech/non-speech detector that would be used in an embodiment of the present method, would be automatic and therefore subject to detection errors. This is due to the fact that, in general, the speech/non-speech decision occurs on the basis of exceeding a threshold $V_T$ (fixed or adaptive), i.e., it is assumed that noise never exceeds such threshold. This is absolutely true only for the statistical average, but noise peaks sometimes exceed such threshold, with a probability of a "false alarm" $p_{fa}$. The probability of a false alarm $P_{fa}$ is used to calculate the term E(A|X,O;H0).

The problem of detection errors is mostly critical in those applications wherein noise has a higher spectral content at lower frequencies, overlapping the low frequency components of the speech signal, as it happens for the case of automobile-noise.

A further improvement to the aforesaid formula, which is particularly advantageous for mobile telephone communications applications, hence consists in expressing the term E(A|X,O;H0) through the formula Rmax*X, where Rmax is given by:

$$KK*\frac{1}{2}\left\{1-erf\left(\sqrt{\ln\frac{1}{p_{fa}}}-\sqrt{\frac{S}{N}}\right)\right\}$$

where $P_{fa}$ is the probability of false alarm in the time interval "i", and S/N is the signal-to-noise power ratio in the time interval "i", and KK is a constant.

As is easily deducible, the signal-to-noise ratio S/N corresponds to the ration $X^2/O$.

The function erf ( . . . ) is the known error function defined as:

$$erf(Z)=\frac{2}{\sqrt{\pi}}\int_0^Z e^{-u^2}\,du$$

In some laboratory tests it has been found that Rmax took values comprised in the interval (0.015, 0.025) choosing KK equal to about 2 (two) and good recognition results were obtained.

The probability of a false alarm in a period of time of time of interest can directly be calculated according to a predetermined noise threshold and to the noise variance in that period of time, as will more fully be pointed out hereinafter.

Such probability can be calculated a priori through the ratio of the average of the time length during which the noise amplitude envelope keeps above such predetermined threshold to the average of the time length from one threshold exceeding and the next one (the averages being calculated during the time of interest), or equivalently, the ratio of the time length during which the envelope keeps above the threshold to the length of the time period of interest.

Naturally, it is advantageous that such predetermined threshold is the same used for speech/non-speech decision, i.e., $V_T$.

The following is a theoretical justification of the expression for Rmax quoted above.

In the hypothesis of Gaussian noise, the probability density of the noise voltage envelope can be expressed through the following Rayleigh probability density:

$$p(R)=\frac{R}{r}\exp\left(-\frac{R^2}{2r}\right)$$

where R is the amplitude of the noise voltage amplitude and r is the variance coinciding with the mean-squared value of the noise voltage, since the mean value is null.

The probability density of a noise-corrupted signal whose amplitude is "A" is then given by the expression of the Rice probability density function:

$$p_s(R)=\frac{R}{r}\exp\left(-\frac{R^2+A^2}{2r}\right)I_0\left(\frac{RA}{r}\right)$$

where $I_o$ ( . . . ) is the zero-order modified Bessel function.

The probability that the signal is correctly detected coincides with the probability that the envelope R exceeds the threshold $V_T$. The detection probability is given by:

$$p_d=\int_{V_r}^{\infty}p_s(R)dR=\int_{V_r}^{\infty}\frac{R}{r}\exp\left(-\frac{R^2+A^2}{2r}\right)I_0\left(\frac{RA}{r}\right)dR$$

This integral is not easily evaluable unless numerical techniques are used. If RA/r>>1, than it can be series expanded and only the first term considered:

$$p_d\cong\frac{1}{2}\left(1-erf\frac{V_T-A}{\sqrt{2}\,r}\right)+\ldots$$

It can be pointed out at once that:

$$\frac{A}{\sqrt{2}\,r}=\sqrt{\frac{S}{N}}=\sqrt{\frac{X^2}{O}}$$

wherein the last equality is valid only in the first approximation.

Moreover, remembering that the false alarm probability can be expressed as:

$$p(V_T < R < \infty) = \int_{V_T}^{\infty} \frac{R}{r} \exp\left(-\frac{R^2}{2r}\right) dR = \exp\left(-\frac{V_T^2}{2r}\right) = p_{fa}$$

it is obtained that:

$$\frac{V_T}{\sqrt{2r}} = \sqrt{1N\frac{1}{p_{fa}}}$$

It may be correctly seen that the expression of Rmax substantially coincides with the detection probability which, in turn, is linked to the false alarm probability and to the signal-to-noise ration.

In an embodiment of the present method, the following choices have been made:

$$E\{A_i(\omega)|X_i(\omega),O_i(\omega);H_1\} = \frac{1}{2}\left(1+\sqrt{1-\frac{1}{X_i^2(\omega)/O_i(\omega)}}\right) * X_i(\omega)$$

$$E\{A_i(\omega)|X_i(\omega),O_i(\omega);H_0\} = KK * \frac{1}{2}\left\{1 - erf\left(\sqrt{1n-\frac{1}{p_{fa}}} - \frac{\sqrt{X_i^2}}{O_i}\right)\right\} * X_i(\omega)$$

$$p(H_1|X_i(\omega),O_i(\omega)) = e^{-n}I_0\left(2\sqrt{n\frac{X_i^2}{O_i}}\right)/1 + e^{-n}I_0\left(2\sqrt{n\frac{X_i^2}{0_i}}\right)$$

$$p(H_0|X_i(\omega),O_i(\omega)) = 1 - p(H_1|X_i(\omega),O_i(\omega))$$

In the last formula it is assumed that events H0 and H1 are equiprobable.

Letter n indicates the a priori signal-to-disturbance ratio in mobile applications, usually chosen in the interval (5, 10); while $I_o$ (...) indicates the zero-order modified Bessel function. In the formulas listed above either the "normal" or the "corrected" spectral envelopes can be used.

When the "corrected" spectral envelope X is used, it has been found to be advantageous to see that the value of $K_x$ to be used in calculating the ratio $X^2/O$ is always chosen in the same range, but greater than the one used elsewhere, in such a way as to attach greater importance to the signal in calculating the signal-to-disturbance ratio than the one attached during the step of noise suppression.

A practical realization of the noise reduction method will now be illustrated through a sequence of steps, for example, as illustrated in FIG. 1.

This realization starts from the assumption of having at disposal, and therefore of operating, on an input sequence of sound signal samples (a noise-corrupted signal). A very usual choice is to sample the sound signal with an 8 KHz sampling rate.

Hence the method realizes the steps of:

(a) subdividing the input sequence into subsequences having the same length corresponding to the length of a predetermined time interval, so that adjacent subsequences have a predetermined number of samples shared, (b) applying a window function to such subsequences thus obtaining windowed subsequences, (c) applying a Fourier transform (e.g., FFT) to such windowed subsequences thus obtaining transformed subsequences, (here, depending on a speech/non-speech decision, estimations of noise corrupted signal amplitude, or noise signal power, are made)

(d) applying a suppression function F(w) to such transformed subsequences thus obtaining filtered subsequences, function F(w) being calculated for each subsequence on the basis of the spectral envelopes X and O in the corresponding subsequence according to the formula:

$$\frac{E\{A|X,O;H1\}}{X} * p(H1|X,O) + Rmax * p(H0|X,O)$$

The suppression function is equivalent to the estimate of the spectral envelope of the speech signal amplitude divided by the spectral envelope of the amplitude of the noise corrupted signal.

(e) applying an inverse Fourier transform (e.g., IFFT) to such filtered subsequences thus obtaining antitransformed sequences, and (f) constructing an output sequence so that adjacent antitransformed subsequences are summed at the ends in such predetermined number of samples.

The spectral envelope O of the noise power, for calculating the suppression function F(w), is calculated for the non-speech subsequences, after having applied a speech/non-speech decision to the subsequences themselves.

In the speech subsequences, the spectral envelope O used in calculating the function F(w) is that corresponding to the last non-speech subsequence.

In a special realization, 256-sample subsequences have been chosen corresponding to 32 ms of sound signal. Further, the adjacent subsequences have been overlapped in 128 samples and the chosen window function is the well known Hamming window.

Still in the aforesaid realization, the antitransformed subsequences calculated in step (e) will be of 256 samples; hence in step (f) the last 128 samples of each subsequence shall be added to the first 128 samples of the next subsequence.

In discrete time systems, i.e., operating on sampled signals, the Fourier transform is replaced by the Discrete Fourier Transform (DFT) and is calculated according to the FFT (Fast Fourier Transform) algorithm. This algorithm, starting from a subsequence of a number of samples, e.g., 256, as a result gives a transformed subsequence of the same length. The same reasoning applies to the inverse Fourier transform.

This realization, just described, is a realization of the method in accordance with the present invention in the frequency domain. Naturally, it is possible to have realizations operating in the time domain, but at the cost of more complicated circuitry or of greater computational complexity.

In the time domain, the computational complexity is given by the product of the number of filters used with the number of products required by each filter with the number of samples per subsequence. For example, a reasonable choice, corresponding to 19, 4, and 256, respectively, leads to about 20,000 products.

In the frequency domain, the computational complexity is given by $N*\log_2 N$, where N is the number of samples per subsequence. The choice of 256 samples leads to about 2,000 products, i.e., a one order of magnitude reduction.

Naturally it is possible to use several filters operating in accordance with the method illustrated above.

It should be apparent that the method and filter according to the present invention could be implemented in a suitably programmed DSP (Digital Signal Processor) or other data processor, since in general the sampling rates called upon and the computations to be carried out are not such to require specifically made architectures.

It will be apparent to one skilled in the art that the manner of making and using the claimed invention has been adequately disclosed in the above-written description of the preferred embodiment taken together with the drawings.

It will be understood that the above description of the preferred embodiments of the present invention are susceptible to various modifications, changes, and adaptations, and the same are intended to be comprehended within the meaning and range of equivalents of the appended claims.

What is claimed is:

1. A noise reduction method using a digital signal processor, the method comprising:

(a) receiving an input signal which could include a noise-corrupted information signal and/or a noise signal;

(b) filtering the noise-corrupted information signal to reduce noise content; and (c) outputting a filtered information signal having the noise content reduced;

wherein the noise-corrupted information signal has an amplitude and the noise signal has a noise signal amplitude and a noise signal power;

wherein the filtering step includes estimating a spectral envelope of the noise-corrupted information signal amplitude using the formula:

$$E(A|X,O;H1)*p(H1|X,O)+E(A|X,O;H0)*p(H0|H,O),$$

where X is the spectral envelope of the amplitude of the noise-corrupted information signal, O is the spectral envelope of the noise signal power, HO denotes the statistical event corresponding to a non-information interval, and H1 denotes the statistical event corresponding to an information interval; and wherein E(A|X,O; HO) is calculated according to the formula Rmax*X, where Rmax is given by:

$$KK*\frac{1}{2}\left\{1-erf\left(\sqrt{1n\frac{1}{p_{fa}}}-\sqrt{\frac{S}{N}}\right)\right\}$$

where $p_{fa}$ is the probability of false alarm in time interval i and S/N is the signal-to-noise power ratio in time interval i.

2. A method according to claim 1, wherein the spectral envelope X in an interval i is corrected according to the formula:

$$\overline{X_i(\omega)}=k_x\overline{X_{i-1}(\omega)}+(1-k_X)X_i(\omega)$$

and wherein the spectral envelope O in the interval i is corrected according to the formula:

$$\overline{O_i(\omega)}=k_o\overline{O_{i-1}(\omega)}+(1-k_o)O_i(\omega)$$

thereby.

3. A method according to claim 2, wherein the probability of a false alarm in a period of time is calculated using the ratio of the length of time during which the envelope of the noise signal amplitude keeps above a predetermined threshold, to the length of said period of time.

4. A method according to claim 3, wherein the filtering step includes making an information/non-information decision using the predetermined threshold.

5. The method according to claim 4, wherein said information signal is a speech signal and wherein said decision is a speech/non-speech decision.

6. A method according to claim 2, wherein the value of $K_x$ is chosen in the interval (0.1, 0.5) and the value of $K_0$ in the interval (0.5, 0.9).

7. The method according to claim 2, wherein the receiving step includes:

(a) subdividing input signal samples into subsequences having the same length corresponding to the length of said time interval, so that adjacent subsequences have a predetermined number of samples shared;

(b) applying a window function to said subsequences thus obtaining windowed subsequences; and (c) performing a Fourier transform to said windowed subsequences thus obtaining transformed subsequences.

8. The method according to claim 7 wherein the filtering step includes making an information/non-information decision, applying the information/non-information decision to said subsequences, and in the case of non-information, calculating the spectral envelope O of the noise signal power for calculating a suppression function F(w).

9. The method according to claim 8, wherein said information signal is a speech signal and wherein said decision is a speech/non-speech decision.

10. The method according to claim 7, wherein the filtering step further includes applying a suppression function F(w) to said transformed subsequences thus obtaining filtered subsequences, said suppression function F(w) being calculated for each subsequence on the basis of said spectral envelopes X and O in the corresponding subsequences, according to the formula:

$$1/X*\{E(A|X,O;H1\}*p(H1|X,O)+E(A|X,O;H0)*p(H0|H,O)\}.$$

11. The method according to claim 7 wherein the outputting step includes:

(a) applying an inverse Fourier transform to said filtered subsequences; and (b) constructing an output sequence so that adjacent filtered subsequence are summed at ends in said predetermined number of samples.

12. The method according to claim 1, wherein said information signal is a speech signal.

13. The method according to claim 1, wherein the digital signal processor is a pre-programmed data processor.

14. A digital signal processor implemented noise reduction filter comprising:

(a) means for subdividing input signal samples of an input signal which may include a noise-corrupted information signal and/or a noise signal each having amplitude, into subsequences having the same length corresponding to the length of a time interval, so that adjacent subsequences have a predetermined number of samples shared;

(b) means for applying a window function to said subsequences thus obtaining windowed subsequences;

(c) means for applying a Fourier transform to said windowed subsequences thus obtaining transformed subsequences;

(d) means for estimating a spectral envelope of the noise-corrupted information signal amplitude using the formula:

$$E(A|X,O;H1)*p(H1|X,O)+E(A|X,O;H0)*p(H0|H,O),$$

wherein E(A|X,O; HO) is calculated according to the formula Rmax*X, where Rmax is given by:

$$KK*\frac{1}{2}\left\{1-erf\left(\sqrt{1n\frac{1}{p_{fa}}}-\sqrt{\frac{S}{N}}\right)\right\}$$

where $p_{fa}$ is the probability of false alarm in time interval i and S/N is the signal-to-noise power ratio in time interval i;

(e) means for applying a suppression function F(w) to said transformed subsequences thus obtaining filtered subsequences, said suppression function F(w) being calculated for each subsequence on the basis of said spectral envelopes X and O in the corresponding subsequence, according to the formula:

1/X*{E(A|X,O;H1}*p(H1|X,O)+E(A|X,O;H0)*p(H0|H,O)}

(f) means for applying an inverse Fourier transform to said filtered subsequences; and (g) means for constructing an output sequence so that adjacent filtered subsequence are summed at ends in said predetermined number of samples.

15. The filter according to claim 14, wherein the information signal is a speech signal.

16. The filter according to claim 14, wherein the digital signal processor is a pre-programmed data processor.

17. The filter according to claim 14, wherein 256-sample subsequences are used corresponding to 32 ms of sound signal, wherein adjacent subsequences are overlapped in 128 samples, and wherein the window function is a Hamming window.

* * * * *